US008979600B2

(12) United States Patent
von zur Muehlen et al.

(10) Patent No.: US 8,979,600 B2
(45) Date of Patent: Mar. 17, 2015

(54) FUSE HOLDER AND FUSE CLIP ASSEMBLY WITH DUAL DIRECTIONAL BIAS ELEMENT SUPPORT

(71) Applicant: Cooper Technologies Company, Houston, TX (US)

(72) Inventors: Alex von zur Muehlen, Wildwood, MO (US); Mengxi Zhao, St. Louis, MO (US)

(73) Assignee: Cooper Technologies Company, Houston, TX (US)

( * ) Notice: Subject to any disclaimer, the term of this patent is extended or adjusted under 35 U.S.C. 154(b) by 0 days.

(21) Appl. No.: 13/626,314

(22) Filed: Sep. 25, 2012

(65) Prior Publication Data

US 2014/0087600 A1 Mar. 27, 2014

(51) Int. Cl.
*H01R 4/48* (2006.01)
*H01H 85/48* (2006.01)

(52) U.S. Cl.
CPC ..... *H01H 85/48* (2013.01)
USPC ..... 439/833; 439/839

(58) Field of Classification Search
CPC ..... H01H 85/202; H01H 85/24
USPC ..... 439/620.08, 620.26–620.34, 830–833, 439/250, 839
See application file for complete search history.

(56) References Cited

U.S. PATENT DOCUMENTS 1,122,754 A * 12/1914 Black ..... 439/698
1,864,283 A * 6/1932 Steinmayer ..... 439/250
1,940,942 A * 12/1933 Dohrwardt ..... 439/250
1,955,251 A * 4/1934 Ohlson ..... 439/807
1,983,281 A * 12/1934 Fries et al. ..... 439/833
2,011,391 A * 8/1935 Bennett ..... 337/196
2,041,613 A * 5/1936 Lincks ..... 439/804
2,292,320 A * 8/1942 Hammerly ..... 439/833
2,325,697 A * 8/1943 Millermaster et al. ..... 200/50.15
2,388,883 A * 11/1945 Taylor ..... 439/366
2,659,063 A * 11/1953 Webb et al. ..... 439/830
2,665,415 A * 1/1954 Kojis ..... 439/832
2,783,331 A * 2/1957 Sundt ..... 337/201
2,889,533 A * 6/1959 Nielsen ..... 439/831
2,942,228 A * 6/1960 Swick ..... 439/698
2,943,295 A * 6/1960 Stewart ..... 439/831
3,076,953 A * 2/1963 Sloop ..... 439/857
3,198,913 A * 8/1965 Stanback ..... 337/209
3,927,929 A * 12/1975 Puetz ..... 439/831
3,960,435 A * 6/1976 Bailey et al. ..... 439/831
3,984,801 A * 10/1976 Mrenna et al. ..... 337/252
4,017,816 A * 4/1977 Latimer, Jr. ..... 337/227
4,097,114 A * 6/1978 Motten, Jr. ..... 439/831
4,108,531 A * 8/1978 Reynolds ..... 439/831
4,128,291 A * 12/1978 Peterson, Jr. ..... 439/786
4,178,063 A * 12/1979 Reynolds ..... 439/831
4,257,662 A * 3/1981 Motten, Jr. ..... 439/831
4,278,316 A * 7/1981 White ..... 439/831
4,391,485 A * 7/1983 Urani ..... 439/687
4,472,018 A * 9/1984 Urani ..... 439/814
4,547,036 A * 10/1985 Keglewitsch et al. ..... 439/680
4,775,338 A * 10/1988 Norden ..... 439/831

(Continued)

*Primary Examiner* — Ross Gushi

(74) *Attorney, Agent, or Firm* — Armstrong Teasdale LLP

(57) ABSTRACT

Fuse holders having a fuse clip assembly configured to support resilient fuse clip arms when subjected to a compression force and also configured to support the resilient fuse clip arms when subject to an expansion force. The bias element is movable relative to the fuse clip arms between first and second positions and prevents deformation of the fuse clip arms.

43 Claims, 6 Drawing Sheets

(56) References Cited

U.S. PATENT DOCUMENTS

| | | | | |
|---|---|---|---|---|
| 4,932,877 | A * | 6/1990 | Zinn | 439/839 |
| 4,971,582 | A * | 11/1990 | Keglewitsch et al. | 439/831 |
| 5,295,850 | A * | 3/1994 | Jeffcoat et al. | 439/266 |
| 7,025,634 | B1 * | 4/2006 | Swantner et al. | 439/619 |
| 7,416,455 | B2 * | 8/2008 | Salo et al. | 439/833 |
| 7,595,715 | B2 * | 9/2009 | Pavlovic et al. | 337/198 |
| 7,766,706 | B2 * | 8/2010 | Kawamura et al. | 439/839 |
| 7,892,050 | B2 * | 2/2011 | Pavlovic et al. | 439/839 |
| 8,026,786 | B2 * | 9/2011 | Darr et al. | 337/268 |
| 8,419,486 | B2 * | 4/2013 | Tyler | 439/842 |
| 8,449,338 | B2 * | 5/2013 | Gong et al. | 439/839 |
| 8,460,009 | B1 * | 6/2013 | Topolewski et al. | 439/65 |
| 8,475,220 | B2 * | 7/2013 | Glick et al. | 439/839 |
| 2013/0023150 | A1 * | 1/2013 | von zur Muehlen | 439/532 |

* cited by examiner

FUSE HOLDER AND FUSE CLIP ASSEMBLY WITH DUAL DIRECTIONAL BIAS ELEMENT SUPPORT

BACKGROUND OF THE INVENTION

The field of the invention relates generally to fuse holders for electrical fuse circuit protection devices, and more specifically to fuse clip assemblies for establishing line and load side electrical connections to terminal elements of overcurrent protection fuses.

Fuses are widely used as overcurrent protection devices to prevent costly damage to electrical circuits. Fuse terminals typically form an electrical connection between an electrical power source or power supply and an electrical component or a combination of components arranged in an electrical circuit. One or more fusible links or elements, or a fuse element assembly, is connected between the fuse terminals, so that when electrical current flow through the fuse exceeds a predetermined limit, the fusible elements melt and opens one or more circuits through the fuse to prevent electrical component damage.

Fuse terminals in the form of resilient clips are known and in widespread use with various types of fuse holders in which the electrical fuses may be removed and replaced while leaving the line and side electrical connections to the fuse holder in place. The resilient clips may be configured to receive and establish mechanical and electrical connection with terminal elements provided on the fuse, such as cylindrical end caps or ferrules, or as another example terminal blade contacts extending from the housing of the fuse. The resilient fuse clip terminals provided in the fuse holders therefore grip corresponding terminal elements of the fuse and provide a contact force to ensure adequate mechanical and electrical connection therebetween.

While resilient fuse clip terminals have been effective to establish mechanical and electrical connections to and through fuses, they can be problematic in some aspects and improvements are desired.

BRIEF DESCRIPTION OF THE DRAWINGS

Non-limiting and non-exhaustive embodiments are described with reference to the following Figures, wherein like reference numerals refer to like parts throughout the various drawings unless otherwise specified.

DETAILED DESCRIPTION OF THE INVENTION

In conventional fuse clip assemblies, springs are sometimes used to provide additional contact pressure with terminal elements of a fuse. Known springs are provided to resist outwardly directed pressure tending to expand the fuse clips and receive a terminal element of the fuse. Except for the mechanical properties of the clips themselves, no features are provided in conventional fuse clips to resist inwardly directed pressure on the fuse clips tending to compress the fuse clips. At times, the mechanical properties of the fuse clips are insufficient to prevent damage to the fuse clips when subjected to compression forces, and improvements are desired.

Exemplary embodiments of fuse holders and fuse clip assemblies therefor are described below that beneficially provide support to the fuse clips not only when expanded, but when compressed. Thus, instead of supporting the fuse clips in a single direction tending to expand the clips as in conventional fuse clip assemblies, the exemplary embodiments disclosed herein support the fuse clip in dual directions both tending to expand the clips as well as compressing them. Method aspects will be in part apparent and in part specifically discussed in the description below.

Figure 1:
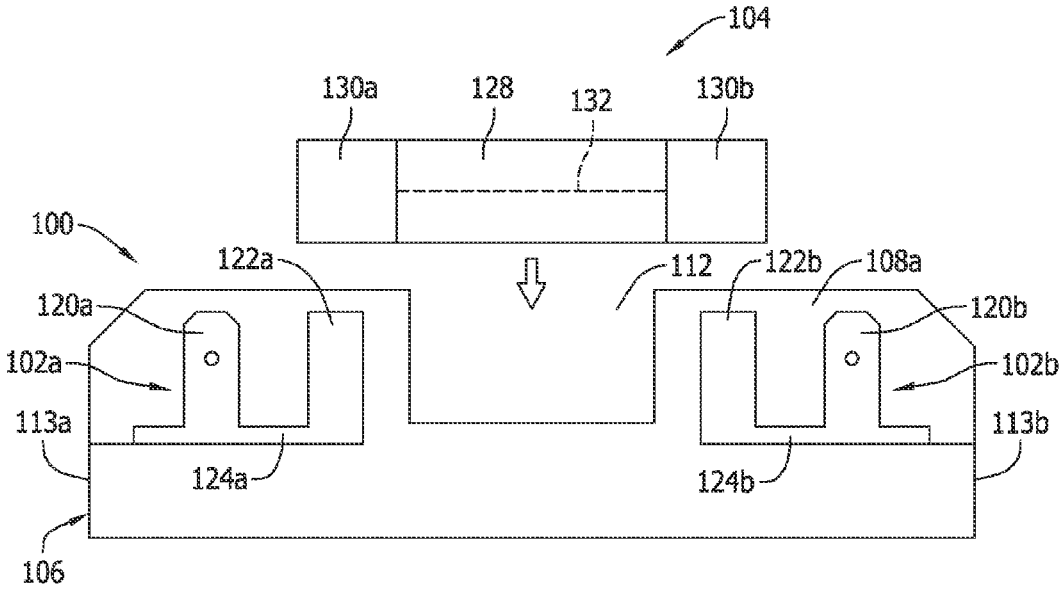
FIG. 1 is a partial side elevational view of an exemplary fuse holder including exemplary fuse clip assemblies receiving an overcurrent protection fuse.
Figure 2:
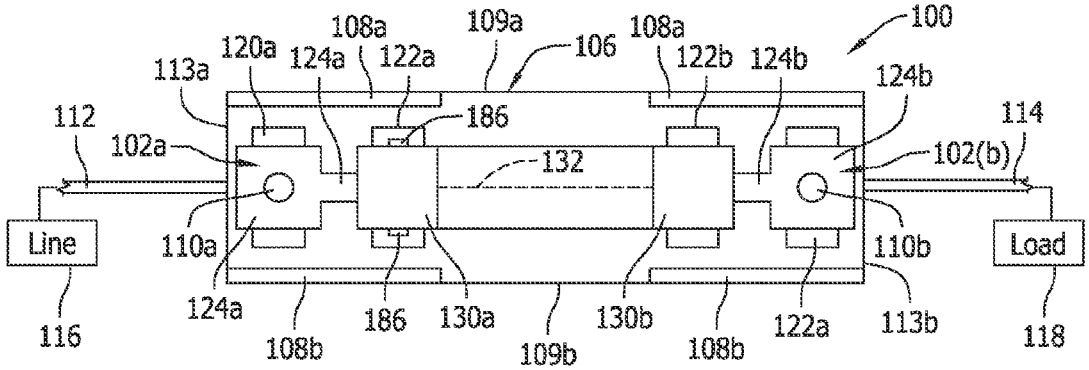
FIG. 2 is a top view of the fuse holder shown in FIG. 1 with the fuse installed to the fuse clip assemblies.

FIG. 1 is a partial side elevational view of an exemplary fuse holder 100 including exemplary fuse clip assemblies 102*a*, 102*b* receiving an overcurrent protection fuse 104 as described below. FIG. 2 is a top view of the fuse holder 100 with the fuse installed 104 to the fuse clip assemblies 102*a*, 102*b*.

In the example depicted, the fuse holder 100 includes a generally elongated base 106 fabricated from an electrically nonconductive or insulative material, and upstanding side walls 108*a*, 108*b* extending from the opposing lateral edges 109*a*, 109*b* of the base 106. The fuse clip assemblies 102*a*, 102*b* are attached to the base 106 at respective locations between the walls 108*a*, 108*b* via a fastener 110*a*, 110*b* such as a screw, a rivet, or other fasteners and fastening techniques known in the art. Openings 112 are centrally located between the side walls 108*a*, 108*b* to facilitate installation and removal of the fuse 104. The side walls 108*a*, 108*b* provide lateral barriers atop the base 106, however, and effectively prevent or preclude inadvertent contact with the fuse clip elements 102*a*, 102*b* from the lateral direction. The longitudinal ends 113*a*, 113*b* of the base 106, however, are open or unobstructed to facilitate connection to electrical conductors such as wires 112, 114 (FIG. 2). The conductor 112 receives electrical power from power supply circuitry, sometimes referred to as the line side circuitry 116, and the conductor 114 supplies power to load side circuitry 118 when the fuse 104 is intact (i.e., fully operative) and installed.

The fuse clip assemblies 102*a*, 102*b* (also shown in FIGS. 3-10) are fabricated from an electrically conductive material and generally include a respective circuit connection portion 120*a*, 120*b*, a fuse clip portion 122*a*, 122*b*, and an anchor portion 124*a*, 124*b*. The circuit connection portion 120*a*, 120*b* in each fuse clip element 102*a*, 102*b* is longitudinally spaced from the fuse clip portion 122*a*, 122*b* as further described below.

The fuse 104 in the embodiment shown generally includes a cylindrical or tubular body 128 fabricated from an electrically nonconductive or insulative material, and electrically conductive terminal elements 130*a*, 130*b* coupled to the opposed axial ends of the fuse body 128. A fuse element 132 (shown in phantom in FIG. 2) is provided internal to the fuse body 128 and is mechanically and electrically connected to the terminal elements 130*a*, 130*b*. The fuse element 132 may include fusible links or elements, or a fuse element assembly as those in the art will appreciate, and is designed to withstand electrical current conditions up to a predetermined limit. When the predetermined limit is exceeded, the fuse element 132 structurally fails and ceases to provide an electrical connection between the terminal elements 130*a*, 130*b*. This condition is referred to as an "open" fuse condition because the fuse 104 essentially creates an open circuit condition to connected circuitry. The opened fuse electrically isolates the load side circuitry 118 from the line side circuitry 116 in response to certain predetermined current conditions in the line side circuitry 116.

In the example shown, the terminal elements 130*a*, 130*b* are cylindrical elements that may be recognized by those in the art as "end caps" or "ferrules." In further and/or alternative embodiments, the fuse 104 may further include contact blades, sometimes referred to as knife blades, projecting from the axial ends of the terminal elements 130*a*, 130*b*. The fuse 104 as shown, however, is provided solely for the sake of illustration rather than limitation, and other types of fuses may accordingly be utilized, including but not limited to rectangular fuse modules having spaced apart terminal blade contacts extending from a common side of a rectangular fuse housing. Such rectangular fuse modules are commercially available from Cooper Bussmann of St. Louis, Mo. and are known in the art as CUBEFuse® power fuses. Any fuse compatible with the fuse clip elements as described below, however, may be suitable for use a fuse holder with appropriate modification.

As best shown in FIG. 2, when the fuse 104 is installed to the fuse holder 100, the fuse terminal elements 130*a*, 130*b* are received by and are in contact with the fuse clip portions 122*a*, 122*b* of the fuse clip assemblies 102*a*, 102*b*. Mechanical and electrical connections are therefore established between the fuse clip portions 122*a*, 122*b* and the fuse terminal elements 130*a*, 130*b*. When the conductors 112, 114 are respectively connected to the connection portions 120*a*, 120*b* of the fuse clip elements 102*a*, 102*b* and the line side circuitry 116 is energized, electrical current flow through the fuse holder 100 is as follows.

Current flows from the line side circuitry 116 through the conductor 112 and to the connection portion 120*a* of the fuse clip assembly 102*a*. From the connection portion 120*a* current flows through the anchor portion 124*a* to the fuse clip portion 122*a*. From the fuse clip portion 122*a* current flows to the fuse terminal element 130*a*, to the fuse element 132 and to the other fuse terminal element 130*b*. From the fuse terminal 130*b* current flows through the fuse clip portion 122*b* of the fuse clip assembly 102*b*. From the fuse clip portion 122*b*, current flows to and through the anchor portion 124*b* to the connection portion 120*b*. From the connection portion 120*b* current flows through the conductor 114 to the load side circuitry 118.

Fusible protection to the line side circuitry 118 is provided via operation of the fuse element 132. When the fuse element 134 opens, electrical component damage to load side circuitry is avoided as the fuse effectively isolates problematic electrical circuit conditions in the line side circuitry 116 from being passed to the load side circuitry 118. To restore operation of the load side circuitry 118, the fuse 104 must be removed and replaced after it has opened. The openings 112 in the base walls 108*a*, 108*b* facilitates fuse installation and removal by providing clearance for a person's fingers to grasp the body 128 of the fuse 104 for installation or removal from the fuse holder 100, or alternatively to provide clearance for a fuse removal tool, sometimes referred to as a fuse puller, that may likewise engage the body 128 of the fuse 104 for its installation or removal.

The fuse holder 100 depicted in FIGS. 1 and 2 resembles a Class J fuse holder, sometimes referred to as a fuse block, such as those commercially available from Cooper Bussmann of St. Louis, Mo. As one example, the fuse holder 104 may have a voltage rating of about 600 V and a current rating of about ½-600 A. The fuse 104 in this example may further be a Class J-type fuse. The exemplary fuse holders shown and described, however, are provided for the sake of illustration rather than limitation, and a variety of other types of fuse holders or fuse blocks may benefit from the fuse clip assemblies described herein, as well as fusible switch disconnect devices such as CubeFuse Compact Circuit Protector Base products available from Cooper Bussmann of St. Louis Mo.

Additionally, while the fuse holder 100 shown in FIGS. 1 and 2 is a single pole fuse holder accommodating a single fuse 104, the fuse holder may likewise be configured to accommodate multiple fuses in, for example, a two pole or three pole arrangement. In a multiple pole embodiment, a set of fuse clip assemblies 102*a*, 102*b* may be provided for each fuse in the fuse holder.

FIGS. 3-9 illustrate further details of exemplary features of the fuse clip element 102*a*. In contemplated embodiments, the fuse clip element 102*b* is substantially identically constructed and mounted to the fuse holder 104 in an inversed or mirror image arrangement, although the fuse clips 102*a*, 102*b* need not be identically constructed in all cases.

Figure 3:
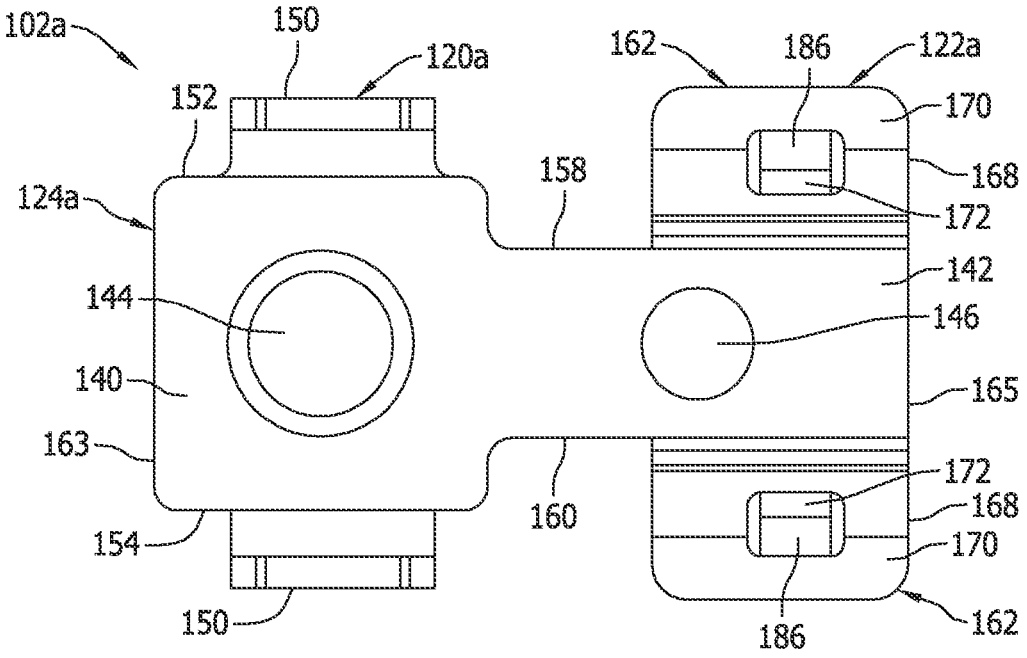
FIG. 3 is a top view of one of the exemplary fuse clip assemblies shown in FIGS. 1 and 2.
Figure 4:
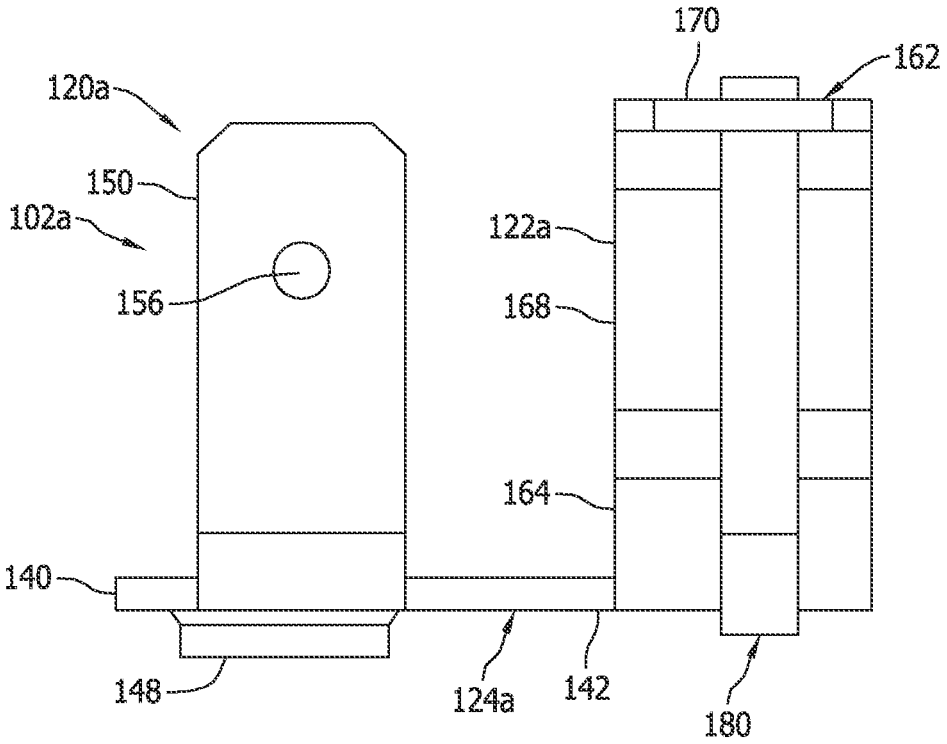
FIG. 4 is a side elevational view of the fuse clip assembly shown in FIG. 3.
Figure 5:
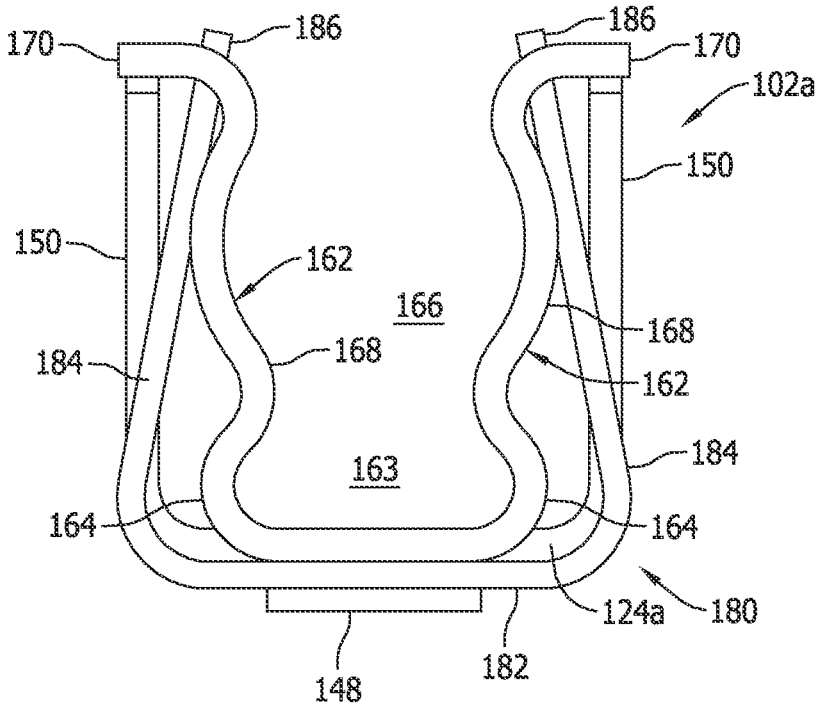
FIG. 5 is an end view of the fuse clip assembly shown in FIG. 3.

FIG. 3 is a top view of the exemplary fuse clip assembly 102*a*. FIG. 4 is a side elevational view of the exemplary fuse clip assembly 104, and FIG. 5 is an end view of the fuse clip assembly 102*a* shown in FIG. 3. As shown in these figures, the anchor portion 124*a* is a generally flat and planar element having a substantially square connection portion 140 and an elongated rectangular section 142 depending from one end of the square section 140. The square section 140 is provided with a first mounting aperture 144 and the rectangular section 142 is provided with a second mounting aperture 146. Either one or both of the mounting apertures 144 and 146 may be used to physically mount the anchor portion 124*a* to the fuse holder base 106 (FIGS. 1 and 2). Also, while the mounting apertures 144 and 146 are shown with different sized diameters, this may be considered optional in some embodiments and the apertures 144, 146 may be the same size. The square section 140 is further shown with an annular boss 148 projecting from a lower side thereof. The boss 148 may assist with seating of the anchor portion 124*a* when assembled to the fuse holder 100, and in some embodiments the boss 148 may be considered optional.

The connection portion 120*a* includes a pair of upstanding flanges or tabs 150 extending from the opposing lateral side edges 152, 154 of the square section 140 and defining the connection portion 120*a*. The tabs 150 may include chamfered distal ends as shown in FIG. 4, and are spaced apart by a sufficient distance to accommodate a terminal (not shown) therebetween to accommodate one of the wire conductors 112, 114 (FIG. 2). For example, wire lug terminals, cage clamp terminals, screw clamp terminals and the like may be utilized to secure connections to the wire conductors. Openings 156 may be provided in the tabs 150 to facilitate mounting of a wire lug terminal or the like. The tabs 150 may be fabricated as integral pieces of conductor material that are formed or bent out of the plane of the square section 140 of the anchor portion 124*a*. In the example shown, the tabs 150 extend at substantially right angles (i.e., perpendicular) to the plane of the anchor portion 124*a*.

The rectangular section 142 of the anchor portion 124*a* in the example shown includes opposing lateral edges 158, 160 that are inset from or inwardly spaced from the lateral edges 152, 254 of the square section 140. In other words, the dimensional distance from lateral edge 158 to lateral edge 160 of the rectangular section 142 is smaller than a dimensional distance from lateral edge 152 to lateral edge 154 of the square section 140. A pair of resilient clip arms 162 extends upwardly from each of the lateral side edges 158, 160 of the rectangular section 142 in a spaced relation from the tabs 150 and define the clip portion 122*a* of the fuse clip assembly 102*a*. The clip arms 162 and the tabs 150 are spaced longitudinally from one another along an axis of the assembly extending between the opposing longitudinal edges 163, 165 of the anchor portion 124*a*.

As best seen in FIG. 5, the clip arms 162 in the example shown have a rather complex convex and concave curvature defining a first interior space 163 between lower arm sections 164 having a first curvature, and a second interior space 166 defined by second portions 168. The curvature of the second portions 168 generally complements the outer circumference or profile of the fuse terminal elements 130, 132 (FIGS. 1 and 2). It is understood, however, that in embodiments wherein the fuse terminals include knife blade contacts or terminal blade contacts, the curvature of the clip arms 182 need not be the same as that depicted in the Figures, and perhaps the arms 162 in some embodiments need not be curved at all.

The distal ends of the clip arms 162 each include flared sections 170 that extend in a spaced part, but generally parallel relationship to the anchor portion 124*a* in a relaxed or resting position shown in FIG. 5. The flared sections 172 extend outwardly away from one another in opposite directions and in the position shown in FIG. 5 are generally coplanar to one another. As best shown in FIG. 4, slots 172 are formed in the clip arms 162 proximate the junction of the flared sections 170 and the second portions 168 of the arms 122. As such, part of the slot 172 resides in each flared section 172 and part of the slot 170 resides in the second arm portion 168.

The fuse clip arms 162 may be fabricated as integral pieces of conductor material that are formed or bent out of the plane of the rectangular section 142 of the anchor portion 124*a*. In the example shown, the fuse clip arms 162 are generally inset from the tabs 150 of the connector portion 120*a*. That is the fuse clip arm sections 164 and 168 are spaced apart in a lateral direction by an amount less than the tabs 150 are spaced apart. The flared sections 172 of the fuse clip arms 162 extend outwardly and the distal ends thereof are spaced apart by a distance approximately equal to the distance by which the tabs 150 are spaced apart.

As best shown in FIGS. 4 and 5, a bias element 180 is coupled to the clip portion 122*a*. In the example shown, and as best seen in FIG. 5, the bias element 180 includes a straight and generally planar lower section 182 that engages the lower side of the anchor portion 124*a*, and a pair of resilient arms 184 extending upwardly from the lower section 182 but obliquely with respect to one another. Distal ends 186 of the arms 184 extend through the slots 172 in the clip arms 162 and as shown in FIG. 5 the arms 184 are inclined such that the distal ends 186 are separated by a distance, measured in a direction parallel to the plane of the anchor portion 124*a*, that is less than a corresponding dimension of the lower section 182. Alternatively stated, and in the position shown in FIG. 5, the arms 184 extend inwardly toward one another from opposing ends of the lower section 182 of the bias element 180. The arms 184 of the bias element 180 in the exemplary embodiment shown, however, are straight or linear and lack any curvature. Other configurations of the bias element are, however, possible.

The bias element 180 in contemplated embodiments is separately fabricated from the fuse clip arms 162 and provides dual directional support to the fuse clip arms 162 that is advantageous for the reasons discussed below. The bias element 180 may be fabricated from conductive or nonconductive materials as desired. As seen in FIG. 3, the slots 172 in the fuse clip arms 162 are wider than the bias element arms 184 are thick. As such, and because of the wider slots 162, relative freedom of movement in the lateral direction is provided between the fuse clip arms 162 and the bias element arms 184 when the distal ends 186 of the bias element arms 164 are located in the slots. Further, while the bias element arms 184 and/or the fuse clip arms 162 may move by virtue of the slots 172 up to a predetermined amount determined by the width of the slot, the bias element arms 184 cannot separate from the fuse clip arms 162 once the fuse holder 100 is assembled.

Figure 6:
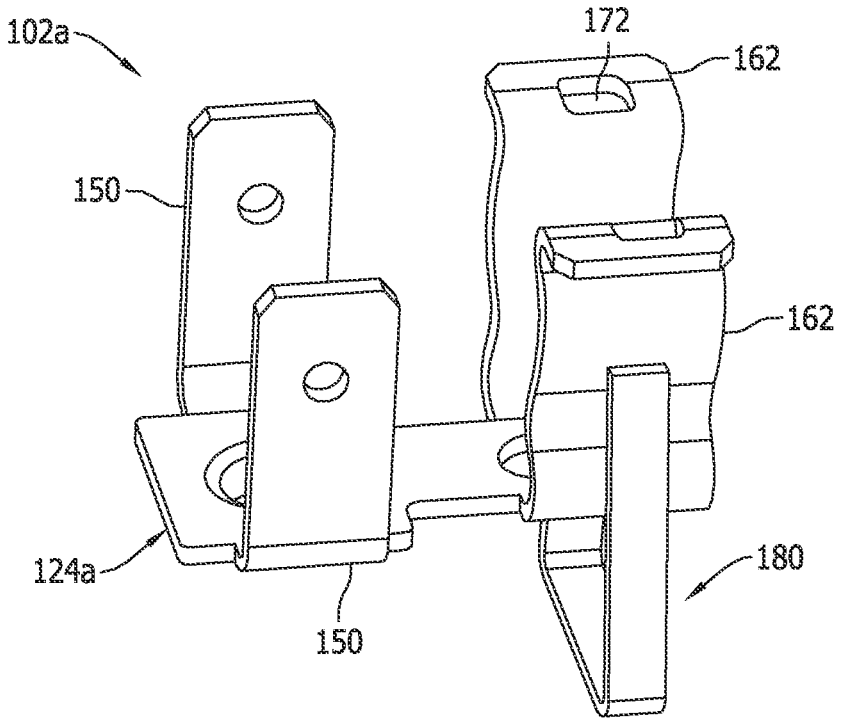
FIG. 6 is a first assembly view of the fuse clip assembly shown in FIGS. 3-5.

FIG. 6 is a first assembly view of the fuse clip assembly 102*a*. The tabs 150 and the fuse clip arms 162 are shown fully formed, although they are fabricated from the same piece of conductive material as the anchor portion 124*a* in the example shown. The bias element 180 is also fully formed, and in FIG. 6, the bias element 180 is extended from the underside of the anchor portion 180 and the outer sides of the fuse clip arms 162.

Figure 7:
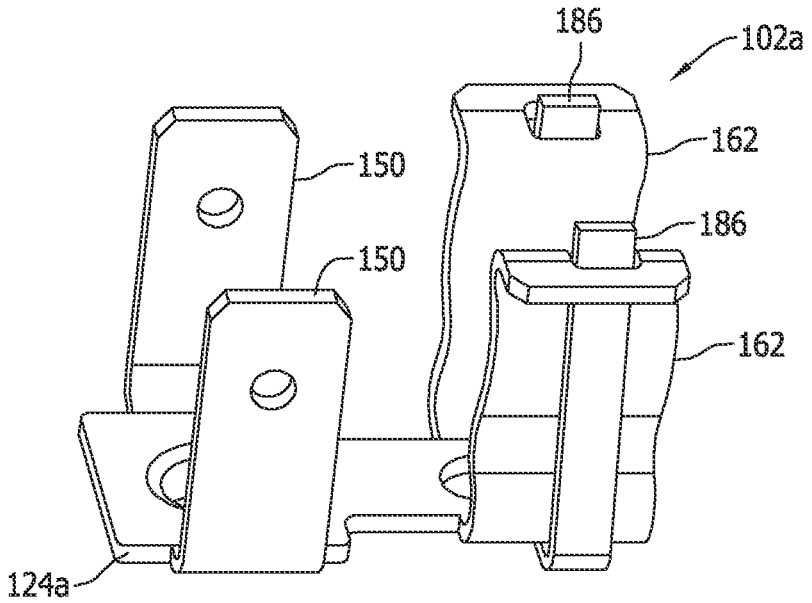
FIG. 7 is a second assembly view of the fuse clip assembly shown in FIG. 6.

FIG. 7 is a second assembly view of the fuse clip assembly 102*a* with the ends 186 of the bias element 180 extended through the slots 172 in the fuse clip arms 162. The extension of bias element ends 186 into the slots 172 positively engages the bias element ends 186 and facilitates the dual directional support both when the fuse clip arms 162 are subjected to expansion forces as described below, as well as compression forces. Conventional fuse clips, however, lack positive engagement of a bias element that would provide any support if the fuse clip arms is subject to compression forces.

Once the bias element 180 is assembled to the fuse clip arms 162 to complete the fuse clip assembly 102*a*, the arrangement shown in FIGS. 3-5 is accomplished and the fuse clip assembly 102*a* is now ready for installation to the fuse holder 100.

Figure 8:
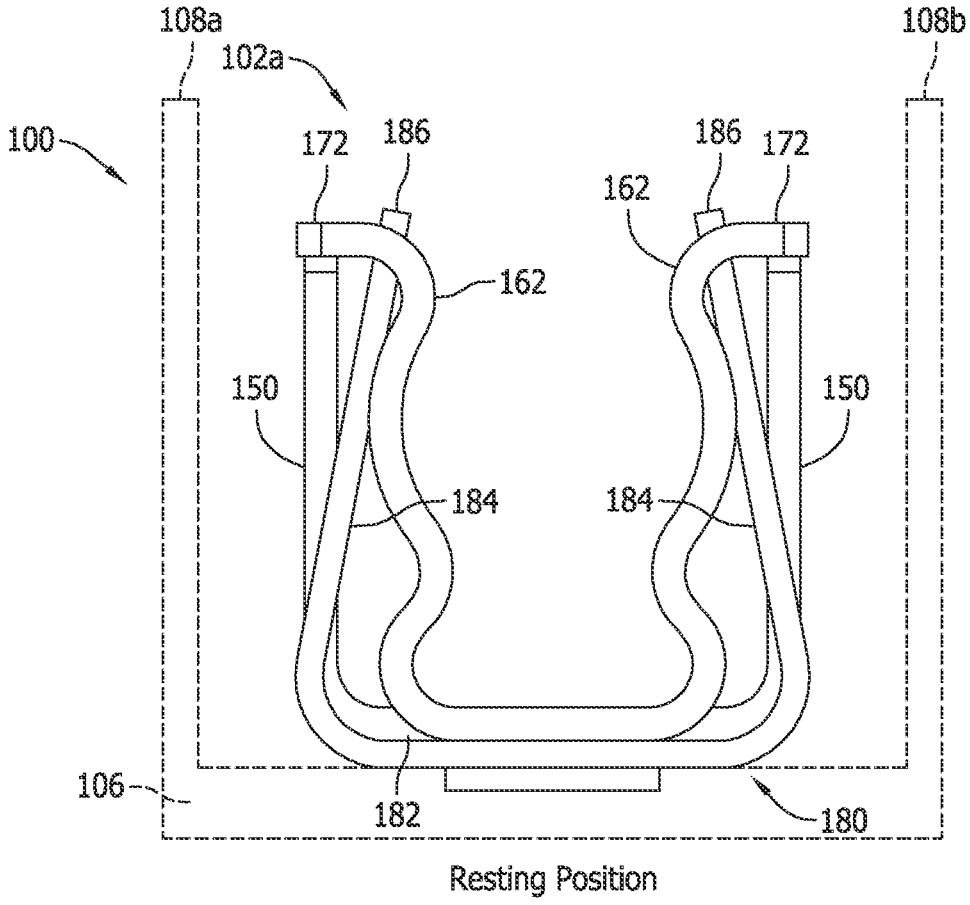
FIG. 8 is an end view of the fuse clip assembly shown in FIGS. 3-5 in a resting position.

FIG. 8 is an end view of the fuse clip assembly 102*a* mounted to the fuse holder 100 (shown in phantom) and in a first position referred to herein as resting or relaxed position. In the resting position, the bias element arms 184 are inwardly inclined toward one another as substantially shown and described above in relation to FIG. 5. In the rest position, there is no externally applied force to the fuse clip assembly 102*a*.

Figure 9:
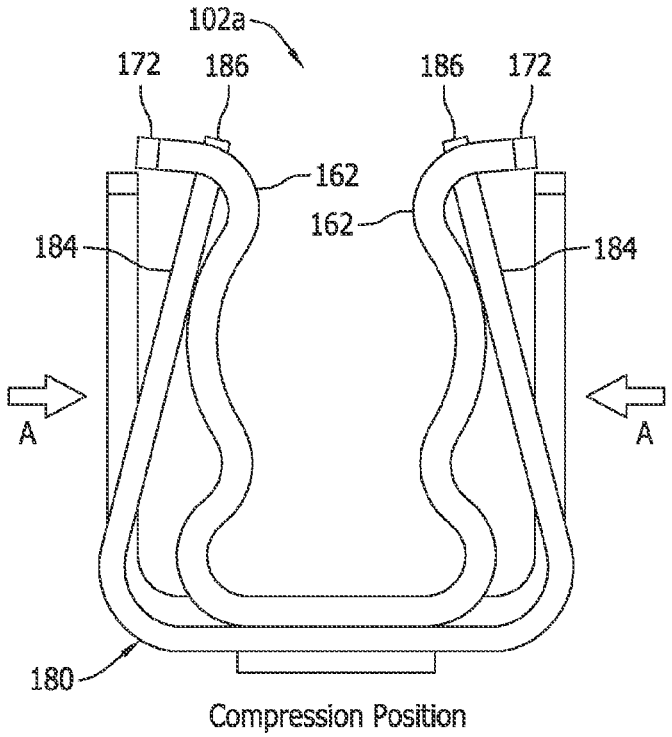
FIG. 9 is an end view of the fuse clip assembly shown in FIGS. 3-5 in a compressed position.

FIG. 9 is an end view of the fuse clip assembly 102*a* in a compressed position subject to an inwardly directed force as represented by one or both of the arrows A. The fuse clip arms 162 and the bias element arms 184 are gathered together as a result of the force(s) A, and the ends 186 of the bias element 180 are closer together than as shown in FIG. 8 in the resting position. The slots 172 in the fuse clip arms 162 allow the bias element ends 186 to move freely relative to the fuse clip arms 162 to a predetermined degree, but thereafter actively resist further movement of the fuse clip arms 162 when subjected to the compressive force(s) A. The ends 186 of the bias elements 180 remain engaged to the fuse clip arms 162 and provide support to the ends of the fuse clip arms 162 that would not otherwise exist in this condition.

In conventional fuse clip assemblies, otherwise similar bias elements for the fuse clip arms may become mechanically uncoupled from the fuse clips when they are subjected to compression forces, and thus fail to provide any support to the fuse clip arms in such a condition. Conventional fuse clip assemblies are thus prone undesirable deformation when subjected to compression forces, while the fuse clip assembly 102*a* is comparatively much stronger and less likely to be deformed or damaged as a result of compression forces. Compression forces may inadvertently result in a variety of ways during manufacturing, shipping, handling, installation and even maintenance procedures of the fuse holder in use.

Figure 10:
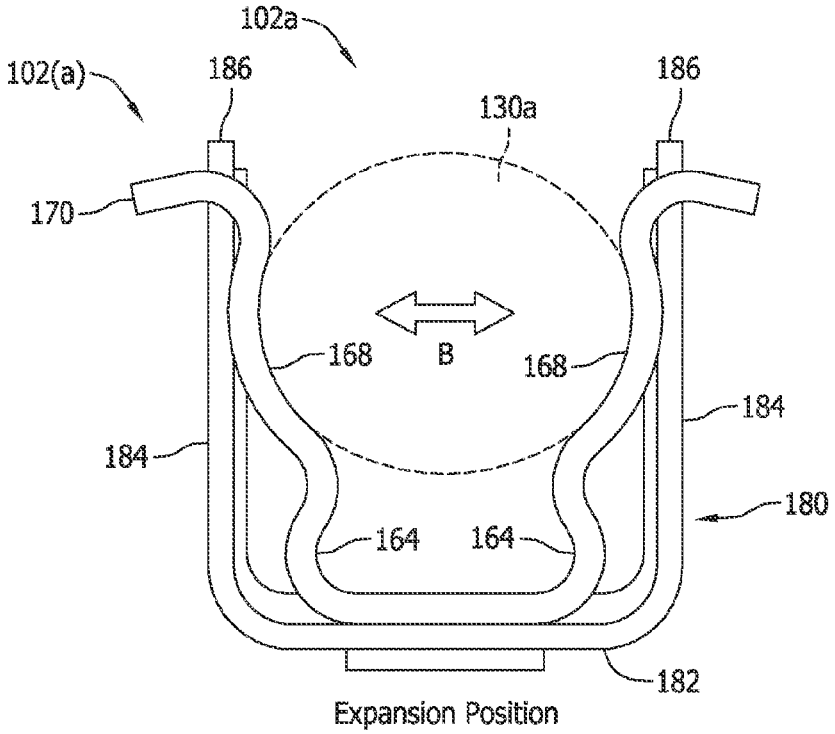
FIG. 10 is an end view of the fuse clip assembly shown in FIGS. 3-5 in an expanded position.

FIG. 10 is an end view of the fuse clip assembly 102*a* in an expanded position wherein the fuse clip arms 162 are subjected to outwardly directed forces as represented by the arrows B. This may be the result of the fuse terminal element 130 (shown in phantom in FIG. 10) being received in the fuse clip arms 162. The fuse clip arms 162 and the bias element arms 184 are spread apart as a result of the force(s) B, and the ends 186 of the bias element 180 are farther apart than as shown in the rest position of FIG. 8. The slots 172 in the fuse clip arms 162 allow the bias element ends 186 to move freely relative to the fuse clip arms 162 to a predetermined degree, but thereafter actively resist further movement of the fuse clip arms 162 when subjected to the expansion force(s) B. The resilient arms 184 of the bias element 180 in this condition support the fuse clip arms 162 both at the distal ends 170 via the slots 172, and also are surface engagement with the outer side of the sections 168 of the fuse clip arms 162 and thus provide support where the wherein the expansion forces are the greatest with the fuse 104 installed.

In contrast to a conventional retaining spring of conventional fuse clips, which support the fuse clip arm only in a single direction when subjected to external force, namely when a fuse is inserted into the clips and the clips expand out, the fuse clip assembly 102*a* including the bias element 102*a* not only supports the fuse clip arms 162 against when expanded as shown in FIG. 10, but also supports the fuse clip arms 162 when they are being compressed as shown in FIG. 9. A number of benefits flow from this dual directional support provided in the fuse clip assembly 102*a*.

For example, the fuse clip arms 162 (and also the associated anchor portion 124*a* when the arms 162 are integral with the anchor portion) can be reduced in weight, size and/or cost by using thinner and/or softer more flexible materials. The fuse clip arms 162, because of the dual directional support of the bias element 180, need not be as structurally strong as in conventionally provided fuse clips. In certain instances, this may facilitate a reduction in size of the overall fuse holder as well as a reduction in size and cost of the fuse clips.

Manufacturing advantages also accrue as the fuse clips are less likely to be deformed during manufacturing processes. Shipping, transit, and distribution of the fuse holder is also less likely to result in deformed fuse clips.

Conventional fuse clips are typically able to withstand some amount of inward deflection due to their own mechanical properties, but it is not difficult to exceed the natural strength of the fuse clips against inward deflection, which sometime can occur inadvertently in the field, especially in open-style fuse holders such as the fuse holder 104 wherein the fuse clips are exposed and unprotected from the top and ends of the fuse holder. The extra strength provided by the positive engagement of the bias element ends 180 and the slots 172 of the fuse clip arms 162 is much less likely to be exceeded, and the associated problems are avoided.

If the fuse clip arms were to deform under compressive load, as conventional fuse clips are vulnerable to, greater mechanical stress in the fuse clip may result with a greater chance of fatigue failure as the fuse holder is used. By avoiding deformation under compressive loads, any premature failure of the fuse clip because of such deformation, and also any associated perception that the fuse holder may be of low quality is avoided. A longer working life of the fuse holder 100 is therefore made possible in many instances, particularly with respect to fatigue resistance.

Even if not problematic from a mechanical stress perspective, in open-style fuse holders such as the fuse holder 104 wherein the fuse clips are visible, even the appearance of a deformed fuse clip can be perceived as an indication of poor quality of the fuse holder. The dual directional support of the bias element 180 in the fuse clip assembly 102*a* not only avoids an impression of lower quality, but actually improves the quality of the fuse holder 100 by avoiding deformation of the fuse clip arms 162 altogether when subjected to compressive force.

The benefits and advantages of the inventive concepts disclosed are now believed to have been amply illustrated and are evident in the exemplary embodiments disclosed.

A fuse clip assembly for establishing an electrical connection to an overcurrent protection fuse including a conductive terminal has been disclosed. The fuse clip assembly includes: a pair of resilient fuse clip arms adapted to engage and retain the conductive terminal of the fuse; and a bias element coupled to the pair of resilient fuse clip arms, the bias element configured to resist deformation of the pair of resilient fuse clip arms when subjected to a compressive force and configured to support the pair of resilient fuse clip arms when subjected to an expansion force.

Optionally, the pair of resilient fuse clip arms each may include a respective slot, and a portion of the bias element extends through each respective slot of the pair of resilient fuse clip arms. The bias element may include a pair of resilient arms, and each of the pair of resilient fuse clip arms of the bias element may extend through the respective slots of the pair of fuse clip arms. The pair of resilient fuse clip arms may each include a distal end, and each respective slot may be located proximate the distal end.

The resilient bias element may include a generally planar section, and upstanding resilient arms extending obliquely from the generally planar section. A portion of each fuse clip arms may have a concave curvature complementary to a shape of the terminal element of the fuse. The fuse clip assembly may further include an anchor portion, and the pair of fuse clip arms may extend upwardly from the anchor portion. A connection portion may extend from the anchor portion, and the connection portion may be spaced from the pair of fuse clip arms. The connection portion and the fuse clip arms may be integral with the anchor portion. The bias element may be separately provided from the anchor portion.

The fuse clip assembly may be combined with the fuse, and the terminal element comprises one of a ferrule, an end cap, a knife blade contact, and a terminal blade.

An embodiment of a fuse holder for an electrical fuse having at least one conductive terminal element has been disclosed. The fuse holder includes: a base fabricated from an electrically nonconductive material; and a fuse clip assembly mounted to the base and configured to establish an electrical connection to the conductive terminal element of the overcurrent protection fuse. The fuse clip assembly includes: a pair of resilient fuse clip arms adapted to engage and retain a the terminal element of the fuse; and a bias element coupled to the pair of resilient fuse clip arms, the bias element movable relative to the pair of resilient fuse clip arms to a first position configured to resist deformation of the pair of resilient fuse clip arms when subjected to a compressive force and to moveable relative to the pair of resilient fuse clip arms to a second position configured to support the pair of resilient fuse clip arms when subjected to an expansion force.

Optionally, the pair of resilient fuse clip arms may each include a respective slot, and a portion of the bias element may extend through each respective slot of the pair of resilient fuse clip arms. The bias element may include a pair of resilient arms, and each of the pair of resilient fuse clip arms of the bias element may extend through the respective slots of the pair of fuse clip arms. The pair of resilient fuse clip arms each has a distal end, and each respective slot may be located proximate the distal end.

The resilient bias element may include a generally planar section, and upstanding resilient arms extending obliquely from the generally planar section. A portion of each fuse clip arm may have a concave curvature complementary to a shape of the conductive terminal element of the fuse.

The fuse holder may further include an anchor portion, the pair of fuse clip arms extending upwardly from the anchor portion. A connection portion may extend from the anchor portion, and the connection portion may be spaced from the pair of fuse clip arms. The connection portion and the fuse clip arms may be integral with the anchor portion. The bias element may be separately provided from the anchor portion.

The fuse holder may be combined with the fuse, and the terminal element may include one of a ferrule, an end cap, a knife blade contact, and a terminal blade.

An embodiment of a fuse holder for an electrical fuse having first and second conductive terminal elements and a fuse element therebetween has been disclosed. The fuse holder includes: a base fabricated from an electrically non-conductive material, and a first fuse clip assembly and a second fuse clip assembly mounted to the base in spaced apart relation to one another. Each of the pair of fuse clip assemblies are configured to establish an electrical connection to a respective one of the first and second terminal elements of the electrical fuse, and at least one of the first and second fuse clip assemblies includes: a pair of resilient fuse clip arms each adapted to engage and retain one of the first and second conductive terminal elements of the electrical fuse, and each of the pair of resilient fuse clip arms including a slot having a first width; and a bias element coupled to the pair of resilient fuse clip arms, the bias element including a pair of resilient arms having a thickness less than the first width, wherein the resilient arms of the bias element respectively pass through the slots in each pair of resilient fuse clip arms and a relative degree of freedom of movement of the resilient arms of the bias element relative to the fuse clip arms is provided in each respective slot, whereby the resilient fuse clip arms are movable to a first position to support the fuse clip arms when subjected to a compressive force and whereby the resilient fuse clip arms are movable to a second position to support the pair of resilient fuse clip arms when subjected to an expansion force.

Optionally, each of the pair of resilient fuse clip arms comprises a curved section, the curved section complementary to a curvature of the terminal element of the fuse.

The fuse holder may be combined with the fuse, and the terminal element may include one of a ferrule, an end cap, a knife blade contact, and a terminal blade.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A fuse clip assembly for establishing an electrical connection to an overcurrent protection fuse including a conductive terminal, the fuse clip assembly comprising:

a pair of resilient fuse clip arms adapted to engage and retain the conductive terminal of the overcurrent protection fuse; and a bias element including a pair of resilient bias element arms, wherein the pair of resilient bias element arms comprises first and second arms opposed to each other, wherein each of the pair of resilient fuse clip arms include a proximal end extending from an anchor portion and a distal end opposing the proximal end, each of the opposed first and second arms of the bias element respectively being mechanically coupled to each distal end of the pair of resilient fuse clip arms, and the bias element configured to resist deformation of the pair of resilient fuse clip arms when subjected to a compressive force and configured to support the pair of resilient fuse clip arms when subjected to an expansion force, thereby extending the working life of the fuse clip assembly by improving fatigue resistance.

2. The fuse clip assembly of claim 1, wherein the pair of resilient fuse clip arms each includes a respective slot, and a portion of the bias element extending through each respective slot of the pair of resilient fuse clip arms.

3. The fuse clip assembly of claim 2, wherein each of the pair of resilient fuse clip arms of the bias element extends through the respective slots of the pair of fuse clip arms.

4. The fuse clip assembly of claim 2, wherein each respective slot is located proximate the distal end.

5. The fuse clip assembly of claim 1, wherein the bias element further comprises a generally planar section, the pair of resilient bias element arms respectively extending obliquely from the generally planar section.

6. The fuse clip assembly of claim 1, wherein a portion of each fuse clip arm has a concave curvature complementary to a shape of the conductive terminal of the fuse.

7. The fuse clip assembly of claim 1, the pair of fuse clip arms extending upwardly from the anchor portion.

8. The fuse clip assembly of claim 1, further comprising a connection portion extending from the anchor portion, the connection portion spaced from the pair of fuse clip arms.

9. The fuse clip assembly of claim 8, wherein the connection portion and the fuse clip arms are integral with the anchor portion.

10. The fuse clip assembly of claim 9, wherein the bias element is separately provided from the anchor portion.

11. The fuse clip assembly of claim 1, in combination with the overcurrent protection fuse.

12. The fuse clip assembly of claim 11, wherein the terminal element comprises a ferrule, an end cap, a knife blade contact, or a terminal blade.

13. The fuse clip assembly of claim 1, wherein the opposed first and second arms of the bias element are straight or linear and lack any curvature.

14. The fuse clip assembly of claim 13, wherein the opposed first and second arms of the bias element extend obliquely to one another in a resting position.

15. The fuse clip assembly of claim 13, wherein the bias element further includes a straight and generally planar lower section, and the opposed first and second arms of the bias element extending from the straight and generally planar lower section.

16. The fuse clip assembly of claim 15, wherein the straight and generally planar lower section are engaged to the anchor portion.

17. The fuse clip assembly of claim 16, wherein the anchor portion comprises opposing longitudinal edges, the fuse clip assembly further comprising circuit connection tabs extending from the anchor portion, the pair of resilient fuse clip arms being longitudinally spaced from the circuit connection tabs between the opposing longitudinal edges.

18. A fuse holder for an electrical fuse having at least one conductive terminal element, the fuse holder comprising:

a base fabricated from an electrically nonconductive material; and a fuse clip assembly mounted to the base and configured to establish an electrical connection to the conductive terminal element of the electrical fuse, the fuse clip assembly comprising:

a pair of resilient fuse clip arms adapted to engage and retain the conductive terminal element of the electrical fuse; and a bias element coupled to the pair of resilient fuse clip arms, the bias element movable relative to the pair of resilient fuse clip arms to a first position configured to resist deformation of the pair of resilient fuse clip arms when subjected to a compressive force and moveable relative to the pair of resilient fuse clip arms to a second position configured to support the pair of resilient fuse clip arms when subjected to an expansion force, thereby extending the working life of the fuse clip assembly by improving fatigue resistance, wherein the bias element comprises a pair of resilient bias element arms, and wherein the pair of resilient bias element arms are straight or linear and lack any curvature.

19. The fuse holder of claim 18, wherein the pair of resilient fuse clip arms each includes a respective slot, and a portion of the bias element extending through each respective slot of the pair of resilient fuse clip arms.

20. The fuse holder of claim 19, wherein the pair of resilient bias element arms extends through the respective slots of the pair of fuse clip arms.

21. The fuse holder of claim 20, wherein the pair of resilient fuse clip arms each comprises a distal end, and each respective slot is located proximate the distal end.

22. The fuse holder of claim 18, wherein the bias element comprises a generally planar section, and wherein the air of resilient bias element arms extend obliquely from the generally planar section.

23. The fuse holder of claim 22, wherein the fuse clip assembly further comprises an anchor portion, and wherein the generally planar section of the bias element is engaged to the anchor portion.

24. The fuse holder assembly of claim 23, wherein the anchor portion is elongated and has a longitudinal axis, wherein the fuse clip assembly further comprises circuit connection tabs extending from the anchor portion, and wherein the pair of resilient fuse clip arms are longitudinally spaced from the circuit connection tabs.

25. The fuse holder of claim 18, wherein a portion of each fuse clip arm has a concave curvature complementary to a shape of the conductive terminal element of the electrical fuse.

26. The fuse holder of claim 18, further comprising an anchor portion, the pair of fuse clip arms extending upwardly from the anchor portion.

27. The fuse holder of claim 26, further comprising a connection portion extending from the anchor portion, the connection portion spaced from the pair of fuse clip arms.

28. The fuse holder of claim 27, wherein the connection portion and the fuse clip arms are integral with the anchor portion.

29. The fuse holder of claim 28, wherein the bias element is separately provided from the anchor portion.

30. The fuse holder of claim 27, each of the pair of resilient fuse clip arms including a proximal end extending from the anchor portion and a distal end opposing the proximal end, each of the opposed first and second arms of the bias element respectively being mechanically coupled to each distal end of the pair of resilient fuse clip arms.

31. The fuse holder of claim 18, in combination with the electrical fuse.

32. The fuse holder of claim 31, wherein the terminal element comprises a ferrule, an end cap, a knife blade contact, or a terminal blade.

33. The fuse holder of claim 18, wherein the pair of resilient arms of the bias element extend obliquely to one another in a resting position, and wherein the pair of resilient arms of the bias element is movable from the resting position to one of the first and second positions.

34. A fuse holder for an electrical fuse having first and second conductive terminal elements and a fuse element therebetween, the fuse holder comprising:

a base fabricated from an electrically nonconductive material; and a first fuse clip assembly and a second fuse clip assembly mounted to the base in spaced apart relation to one another, each of the pair of fuse clip assemblies configured to establish an electrical connection to a respective one of the first and second conductive terminal elements of the electrical fuse, at least one of the first and second fuse clip assemblies comprising:

a pair of resilient fuse clip arms each adapted to engage and retain one of the first and second conductive terminal elements of the electrical fuse, and each of the pair of resilient fuse clip arms including a slot having a first width; and a bias element coupled to the pair of resilient fuse clip arms, the bias element including a pair of resilient arms having a thickness less than the first width, wherein the pair of resilient arms of the bias element each comprises a straight or linear arm that lacks any curvature, wherein the resilient arms of the bias element respectively pass through the slots in each pair of resilient fuse clip arms and a relative degree of freedom of movement of the resilient arms of the bias element relative to the fuse clip arms is provided in each respective slot, whereby the resilient fuse clip arms are movable to a first position to support the fuse clip arms when subjected to a compressive force and whereby the resilient fuse clip arms are movable to a second position to support the pair of resilient fuse clip arms when subjected to an expansion force, thereby extending the working life of the fuse clip assembly by improving fatigue resistance.

35. The fuse holder of claim 34, wherein each of the pair of resilient fuse clip arms comprises a curved section, the curved section complementary to a curvature of at least one of the first and second conductive terminal elements of the electrical fuse.

36. The fuse holder of claim 35, in combination with the electrical fuse.

37. The fuse holder of claim 36, wherein at least one of the conductive terminal elements comprises one of a ferrule, an end cap, a knife blade contact, and a terminal blade.

38. The fuse holder of claim 34, wherein the pair of resilient arms of the bias element extend obliquely to one another in a resting position, and wherein the pair of resilient arms of the bias element are movable from the resting position to one of the first position and the second position to support the pair of resilient fuse clip arms.

39. The fuse holder of claim 34, wherein at least one of the first and second fuse clip assemblies further comprises an anchor portion, and wherein the bias element further comprises a straight and generally planar lower section engaged to the anchor portion.

40. The fuse holder of claim 34, wherein each of the pair of resilient fuse clip arms includes a proximal end extending from an anchor portion and a distal end opposing the proximal end, and wherein the slot in each of the pair of resilient fuse clip arms is located at the distal end.

41. The fuse holder of claim 40, wherein the anchor portion is elongated and extends along a longitudinal axis, wherein at least one of the first and second fuse assemblies further comprises a pair of circuit connection tabs extending from the anchor portion, and wherein the pair of resilient fuse clip arms are longitudinally spaced from the circuit connection tabs.

42. A fuse holder for an overcurrent protection fuse having at least one conductive terminal element, the fuse holder comprising:

a base fabricated from an electrically nonconductive material; and a fuse clip assembly mounted to the base and configured to establish an electrical connection to the at least one conductive terminal element of the overcurrent protection fuse, the fuse clip assembly comprising:

a pair of resilient fuse clip arms adapted to engage and retain the terminal element of the overcurrent protection fuse; and a bias element coupled to the pair of resilient fuse clip arms, the bias element movable relative to the pair of resilient fuse clip arms to a first position configured to resist deformation of the pair of resilient fuse clip arms when subjected to a compressive force and moveable relative to the pair of resilient fuse clip arms to a second position configured to support the pair of resilient fuse clip arms when subjected to an expansion force, thereby extending the working life of the fuse clip assembly by improving fatigue resistance;

wherein the bias element comprises a generally planar section, and upstanding resilient arms extending obliquely from the generally planar section;

wherein the fuse clip assembly further comprises an elongated anchor portion having a longitudinal axis, and wherein the generally planar section of the bias element is engaged to the anchor portion; and wherein the fuse clip assembly further comprises circuit connection tabs extending from the anchor portion, and wherein the pair of resilient fuse clip arms are longitudinally spaced from the circuit connection tabs.

43. A fuse holder for an electrical fuse having first and second conductive terminal elements and a fuse element therebetween, the fuse holder comprising:

a base fabricated from an electrically nonconductive material; and a first fuse clip assembly and a second fuse clip assembly mounted to the base in spaced apart relation to one another, each of the pair of fuse clip assemblies configured to establish an electrical connection to a respective one of the first and second terminal elements of the electrical fuse, at least one of the first and second fuse clip assemblies comprising:

a pair of resilient fuse clip arms each adapted to engage and retain one of the first and second conductive terminal elements of the electrical fuse, and each of the pair of resilient fuse clip arms including a slot having a first width; and a bias element coupled to the pair of resilient fuse clip arms, the bias element including a pair of resilient arms having a thickness less than the first width, wherein the resilient arms of the bias element respectively pass through the slots in each pair of resilient fuse clip arms and a relative degree of freedom of movement of the resilient arms of the bias element relative to the fuse clip arms is provided in each respective slot, whereby the resilient fuse clip arms are movable to a first position to support the fuse clip arms when subjected to a compressive force and whereby the resilient fuse clip arms are movable to a second position to support the pair of resilient fuse clip arms when subjected to an expansion force, thereby extending the working life of the fuse clip assembly by improving fatigue resistance;

wherein each of the pair of resilient fuse clip arms includes a proximal end extending from an anchor portion and a distal end opposing the proximal end, and wherein the slot in each of the pair of resilient fuse clip arms is located at the distal end;

wherein the anchor portion is elongated and extends along a longitudinal axis, wherein at least one of the first and second fuse assemblies further comprises a pair of circuit connection tabs extending from the anchor portion, and wherein the pair of resilient fuse clip arms are longitudinally spaced from the circuit connection tabs.

* * * * *